United States Patent [19]

Lancaster

[11] Patent Number: 4,699,126

[45] Date of Patent: Oct. 13, 1987

[54] METHODS AND APPARATUS FOR MASSAGING THE SPINAL AREA AND ADJACENT MUSCLES

[76] Inventor: Charles E. Lancaster, Rte. 1, Box 206B, Iola, Tex. 77861

[21] Appl. No.: 911,487

[22] Filed: Sep. 25, 1986

[51] Int. Cl.[4] ..... A61H 7/00; A61H 11/02

[52] U.S. Cl. ..... 128/52; 128/56

[58] Field of Search ..... 128/63, 61, 60, 58, 128/56, 52

[56] References Cited

U.S. PATENT DOCUMENTS

| | | | |
|---|---|---|---|
| 1,276,526 | 8/1918 | Hardy et al. | 128/52 |
| 1,638,025 | 8/1927 | Everts | 128/33 |
| 2,175,614 | 10/1939 | Redfield | 128/57 |
| 2,577,646 | 12/1981 | Cameron | 128/33 |
| 3,628,528 | 12/1971 | Roberts | 128/57 |
| 4,011,862 | 11/1975 | Kosiak | 128/58 |
| 4,170,989 | 10/1979 | Miniere | 128/52 |

*Primary Examiner*—Edgar S. Burr
*Assistant Examiner*—Tonya Lamb
*Attorney, Agent, or Firm*—E. R. Archambeau, Jr.

[57] ABSTRACT

In the representative embodiment of the present invention described herein, several new and improved methods and apparatus are disclosed for simultaneously massaging the upper and lower back portions of a person lying face-up in a supine position on an upwardly-facing surface.

6 Claims, 9 Drawing Figures

FIG. 3
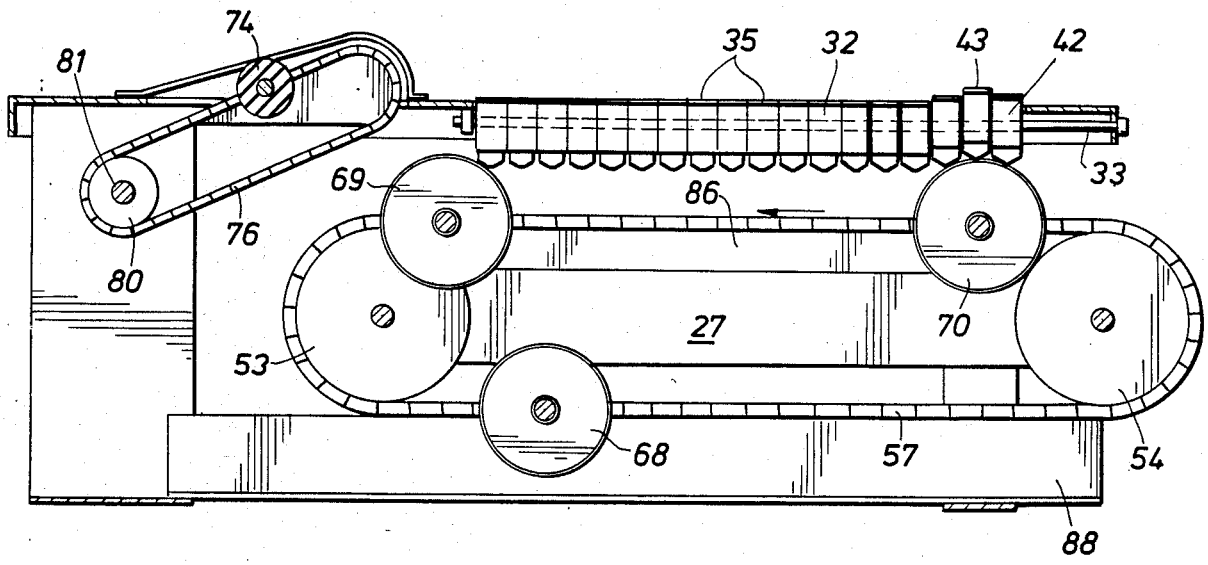
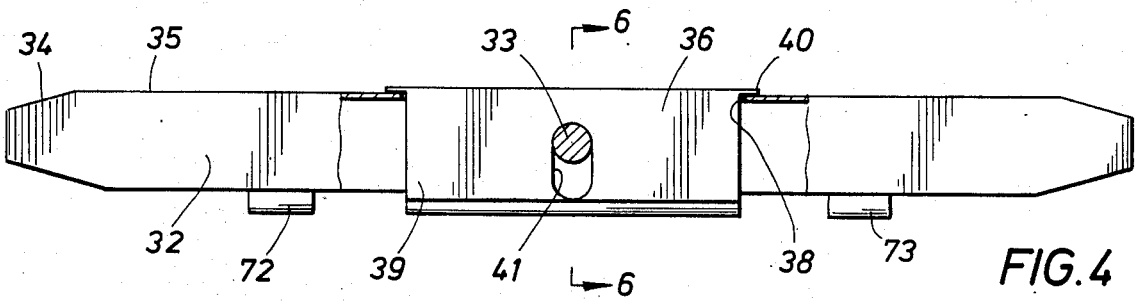
FIG. 4
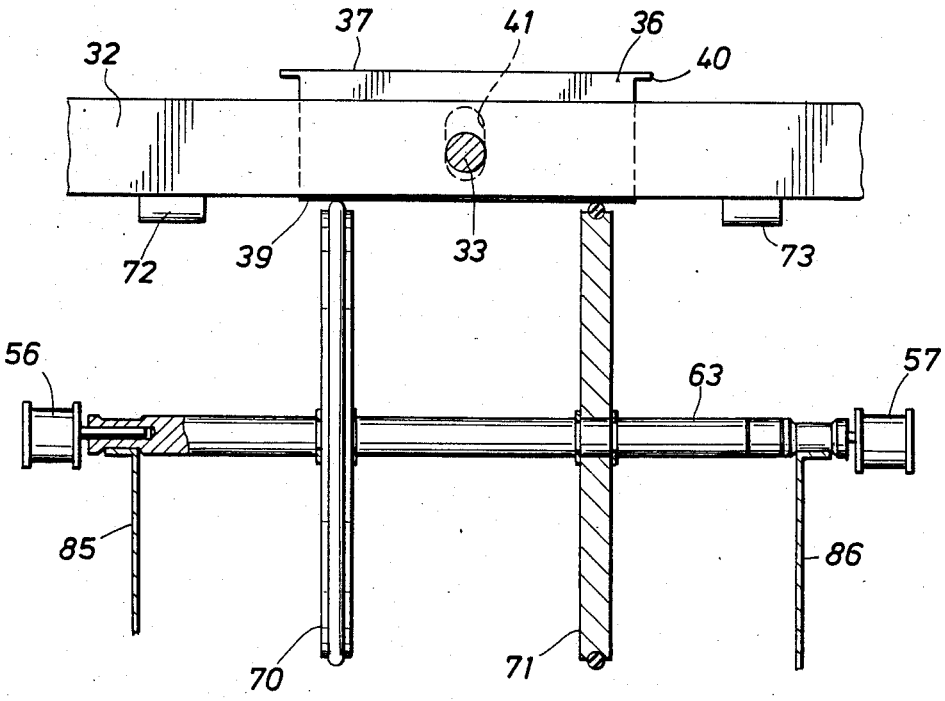
FIG. 5

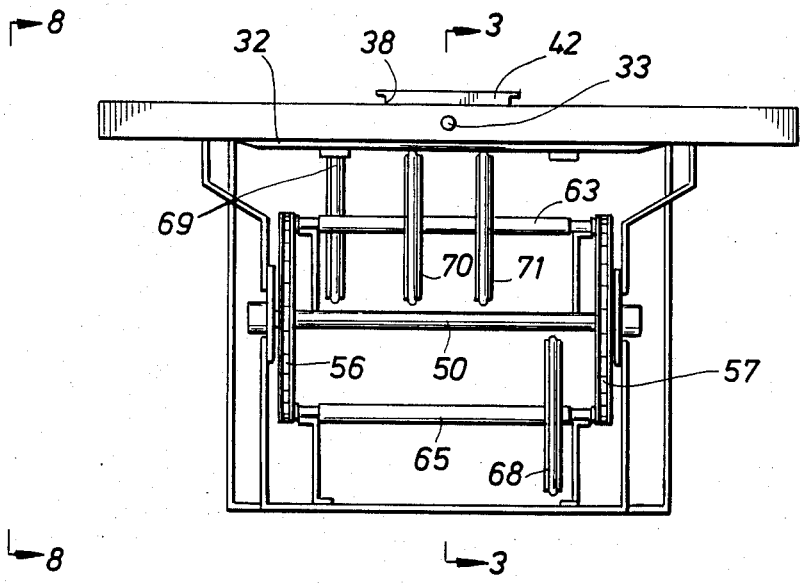
FIG. 7
FIG. 8
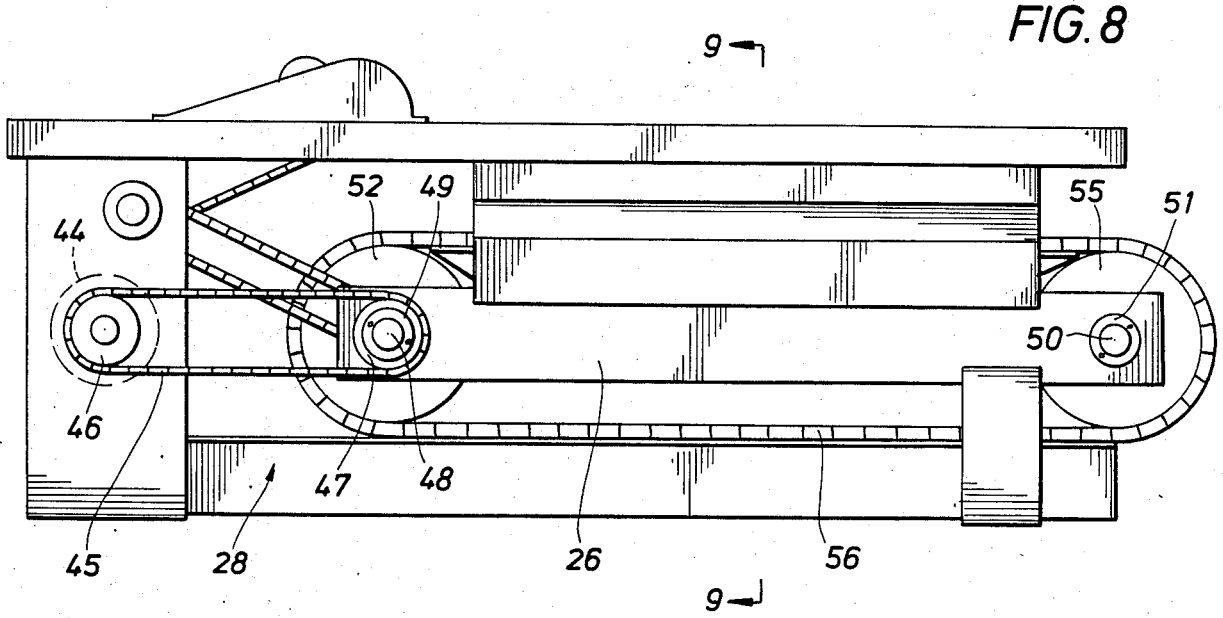
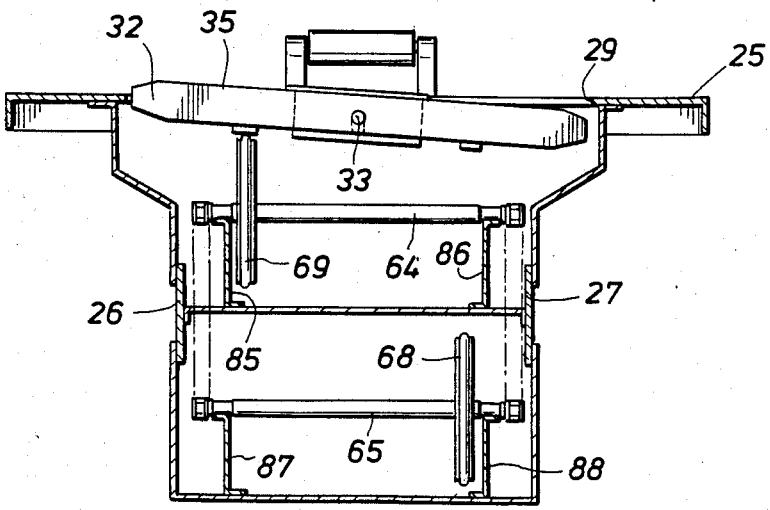
FIG. 9

METHODS AND APPARATUS FOR MASSAGING THE SPINAL AREA AND ADJACENT MUSCLES

BACKGROUND OF THE INVENTION

It is, of course, customary for trained personnel such as masseurs, athletic trainers and chiropractors to massage the spinal areas and selected back portions of a client, player or patient. Although there are different manual techniques which are still employed, various massage machines have been developed for repetitively flexing the back muscles on each side of the spinal column of a person lying in a supine position. A typical one of these machines is seen in U.S. Pat. No. 2,175,614 which machine includes a plurality of horizontal transversely-oriented rollers that are respectively supported by upright coil springs that are arranged along each side of a carriage which is movably mounted on parallel horizontal tracks. To operate the machine, the carriage is moved back and forth along its tracks so that the rollers will massage the back of a person lying face-up on a hammock suspended just above the rollers.

U.S. Pat. No. 2,577,646 discloses a similar massaging machine having a horizontal table that is appropriately sized to accommodate a person lying face up on the table with his spine centered over an elongated longitudinal opening in the central portion of the table. A plurality of transversely-oriented rollers are respectively journalled to the edges of paralleled endless belts that are cooperatively arranged just below the surface of the table on each side of the opening. By driving the belts in unison, the rollers are successively moved along the length of the elongated opening so as to impart a rolling action to the spinal region of the person lying on the table. U.S. Pat. No. 4,011,862 shows a similar massaging machine which instead has two sets of transverse rollers that have their outer ends slightly elevated in relation to their respective inner ends which define an upwardly-facing concavity for partially cradling the back of a person as the rollers are moved in unison along each side of the spinal column of that person.

Other prior-art machines have been arranged to impart upward and downward movements to a single transversely-oriented massaging member for achieving a desired massaging action. For instance, the machine disclosed in U.S. Pat. No. 1,638,025 has a matched pair of elongated, sinusoidal bars that are operatively journalled at their ends to a suitable frame so that the bars can be respectively rotated about paralleled longitudinal axes. The curved portions of the sinusoidal bars are transversly aligned and the ends of a plurality of closely-spaced transverse slats are loosely coupled to the curved bars so as to support a person midway between the bars. In this manner, as the bars rotate in unison, the slats will remain horizontal as they move upwardly and downwardly for imparting a combined rocking and undulating motion to the back of a person lying on the slats.

On the other hand, U.S. Pat. No. 3,628,528 shows a machine with a single horizontal roller which is mounted on a carriage that can be moved as required to selectively position the roller below a particular body portion that is considered to require concentrated massaging action. The roller is journalled between two vertically-movable members that are reciprocated in unison by a pair of cranks which are mounted in an out-of-phase relationship on opposite ends of a motor shaft so that rotation of the motor shaft will rock the roller in a vertical plane as its ends are alternately moved upwardly and downwardly by the two members.

It is apparent, however, that neither the machines seen in the aforementioned patents nor those massaging machines which are known to be in use today are capable of imparting independent but coordinated massaging actions to two or more portions on the back of a person. Intead, the machines shown in these several prior-art patents as well as the present-day machines all seem to be directed toward providing only a single type of massaging action. Moreover, from these patents it is readily apparent that heretofore no attempt has been made to impart one type of massaging action to the spinal column itself as a different type of massaging action is simultaneously being imparted to those portions of the back that are disposed along opposite sides of the spinal column.

OBJECTS OF THE INVENTION

Accordingly, it is an object of the present invention to provide new and improved methods and apparatus for developing multiple massaging actions which are independent of one another but are still coordinated so as to impart an improved overall massaging treatment to the back of a person.

It is a further object of the present invention to provide new and improved massaging techniques and apparatus for massaging the back muscles adjacent to the spinal column of a person as the spinal column is simultaneously being extended and flexed.

SUMMARY OF THE INVENTION

These and other objects of the present invention are provided by means of new and improved massaging apparatus which includes a generally-horizontal planar base adapted to support at least the torso of an average adult who is lying face-up on the base and positioned over a central opening that is arranged in the upper surface of the base to provide limited access to the upper, intermediate and lower back portions of that person. The new and improved apparatus of the present invention also include massaging means which are comprised at least first and second sets of transversely-oriented body-contacting members that are respectively disposed at longitudinally-spaced intervals along the central opening and operatively arranged to be independently raised and lowered in relation to one another. Each of the first members is cooperatively arranged to be moved into contact with at least the adjacent upper or dorsal vertebrae of a person lying in a supine position on the base. The other set of these body-contacting members is cooperatively arranged so that each of them will be moved into contact with the adjacent back portions which are laterally disposed on opposite sides of the spinal column and adjacent to the vertebrae contacted by the first members. The massaging apparatus further include driving means for selectively raising and lowering the first and second body-contacting members at various speeds and sequences that may be considered desirable or advantageous for a particular massaging treatment. In this manner, the momentary upward and downward movements of the first and second members will respectively impart improved massaging actions to selected upper back portions of the person who is receiving the treatment.

In the preferred embodiment of the present invention, the massaging means further include a third set of transversely-oriented body-contacting members which are similarly disposed at longitudinally-spaced intervals along the central opening. This third set of body-contacting members are cooperatively associated with the driving means so as to be independently and sequentially raised and lowered above the base for momentarily contacting at least the lumbar vertebrae of a person lying face-up on the base. In the preferred embodiment of the massaging apparatus that is disclosed herein as incorporating the principles of the present invention, the massaging means may also include at least a single transversely-oriented horizontal roller which is cooperatively associated with the driving means so as to be rolled along the cervical or neck vertebrae of a person lying face-up on the base surface for simultaneously massaging the neck of a person as the several body-contacting members are massaging selected portions of his back.

BRIEF DESCRIPTION OF THE DRAWINGS

The novel features of the present invention are set forth with particularly in the appended claims. The invention, together with further objects and advantages thereof, may be best understood by way of the following description of an exemplary method and apparatus incorporating the principles of the present invention as illustrated in the accompanying drawings, in which:

FIG. 3 is a longitudinal cross-sectional view of the new and improved massaging apparatus taken along the line "3–3" in FIG. 1;

FIG. 4 is an enlarged elevational view which shows a preferred arrangement for cooperatively interfitting two of the body-contacting members of the massaging apparatus to achieve the objects of the present invention;

FIG. 5 is an enlarged elevational view of the midportion of the two body-contacting members illustrated in FIG. 4 depicting the driving mechanism of the present invention as it selectively actuates one set of the body-contacting members;

FIGS. 7 and 8 are elevational end and side views that respectively illustrate various details of the new and improved massaging apparatus; and FIG. 9 is a transverse cross-sectional view of the massaging apparatus of the present invention taken along the line "9—9" in FIG. 8.

DETAILED DESCRIPTION OF THE INVENTION

Figure 1:
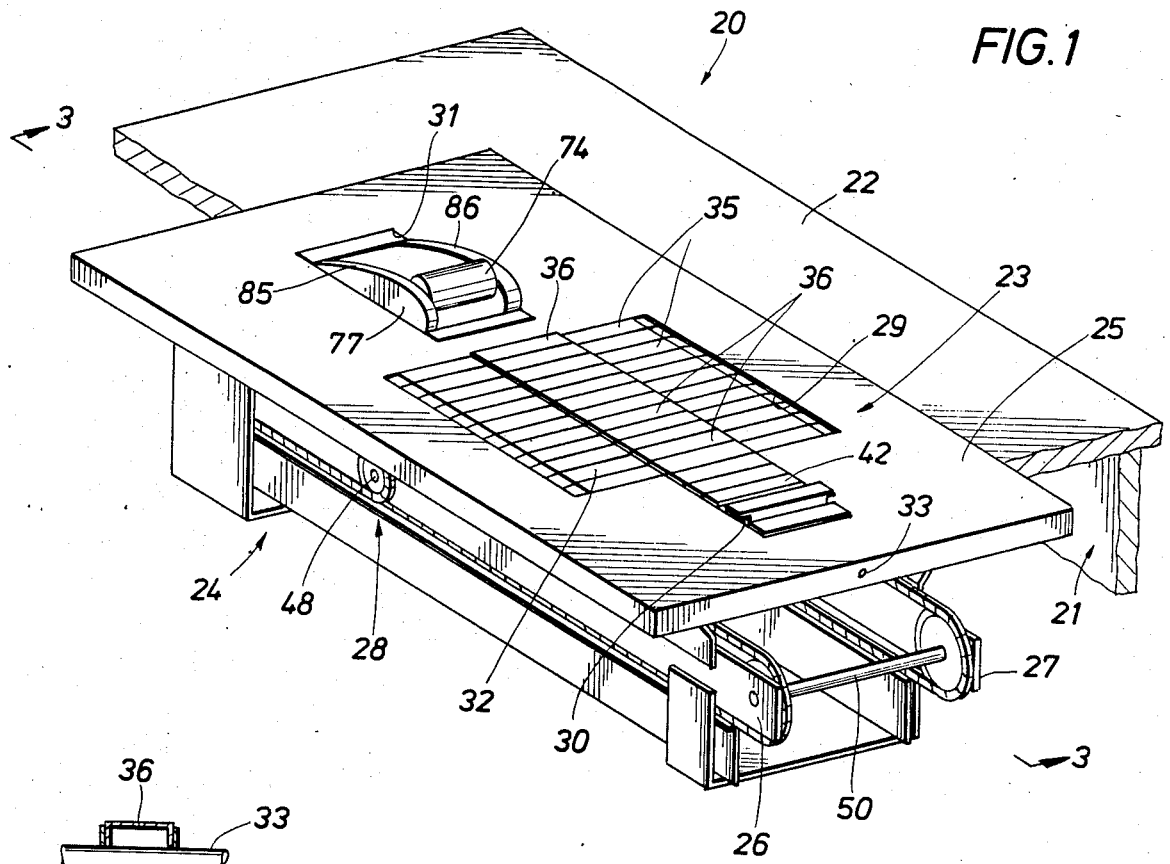
FIG. 1 is an isometric view of a preferred embodiment of a self-contained assembly of the mechanical elements of new and improved massaging apparatus arranged in accordance with the principles of the present invention and adapted for mounting in a suitable cabinet.
Figure 6:
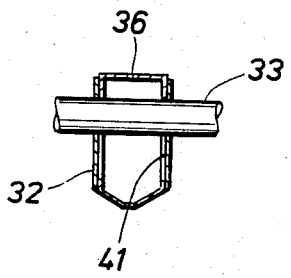
FIG. 6 is an enlarged cross-sectional view taken along the line "6—6" in FIG. 4 and showing a particular detail of the new and massaging apparatus of the present invention.

Turning now to FIG. 1, an isometric view is shown of a preferred embodiment of new and improved massaging apparatus 20 that is arranged in accordance with the principles of the present invention and adapted for independently massaging selected body portions of a person lying face-up on the apparatus. As seen in FIG. 1, the massaging apparatus 20 includes a table or base cabinet as shown generally at 21 having a generally-horizontal, elongated planar top surface 22 adapted to support an adult of typical size lying thereon in a prone position at a convenient elevation above the floor. In carrying out the objects of the present invention, the cabinet 21 is preferably formed as an attractive box-like enclosure which is about 24-inches high and has a top surface 22 that is about 24-inches wide and 5-feet long. Although the top surface 22 can, of course, be of any reasonable size, it has been found that limited dimensions such as these will encourage an adult to lie with his back centered along the central or longitudinal axis of the surface and with his knees fully elevated which causes the mid-portion of his back to be pressed firmly against the top surface and thereby enhance the massaging action of the new and improved apparatus 20. To give the cabinet 21 an attractive and professional appearance, it is preferably constructed with attractive side panels of finished wood or painted metal (not seen in the drawings). Likewise, for purposes of comfort and overall appearance, the top surface 22 is preferably covered with a suitable pliable material (not shown in the drawings) such as a single sheet of natural rubber that is bonded to the underside of a thin sheet of neoprene foam that is itself covered with and bonded on the underside of a strong and durable plastic fabric such as naugahyde.

As depicted in FIG. 1, the new and improved apparatus 20 of the invention further includes powered massaging means 23 preferably arranged as a self-contained interchangeable unit that is adapted to be removably mounted. In this manner, it is, of course, immaterial whether the massaging means 23 are installed on a simple table or are mounted in an elaborate stylish cabinet. By arranging the massaging means 23 as a self-contained unit, it will be appreciated that the repair and replacement of its parts will, of course, be significantly facilitated. As seen in FIG. 1, the massaging means 23 also include a structural assembly or a unitary metal frame 24 that is preferably formed of a large flat horizontal plate 25 and a laterally-spaced pair of depending vertical side members 26 and 27 cooperatively arranged to support a powered driving mechanism 28 just below the cabinet top 22. In the preferred arrangement of the unitary frame 24, the plate 25 is appropriately sized to span the width and length of a smaller complementary opening (not seen in the drawings) in the cabinet top 22. An elongated central opening which is formed along the longitudinal axis of the plate 25 defines a rectangular opening 29 in the mid-portion of the plate which adjoins a somewhat-smaller rectangular opening 30 near one end of the plate, with these two openings being appropriately sized and situated in the plate so as to be respectively located just below the upper and lower back portions of an adult of average size lying face-up on the cabinet top 22. As depicted, a small rectangular opening 31 is also arranged along the longitudinal axis of the plate 25 on the other end of the plate from the opening 30 and cooperatively situated in relation to the larger central opening 29 so that it will be located just below the neck and head of a person lying on the cabinet top 22.

To selectively massage different vertebrae and body portions of a person lying face-up on the cabinet top 22, the massaging means 23 include one group of transversely-oriented massaging members 32 which, in the preferred embodiment of the apparatus 20, are respectively arranged so that their overall length is slightly less than the transverse width of the larger central opening 29. As best seen in FIGS. 3–5, the massaging members 32 are pivotally supported within the opening 29 by an elongated rod 33 which passes through a complementary opening in the mid-point of each massaging member and is secured at the opposite ends of the frame 24 so as to be positioned just below the plate 25 and parallel to its longitudinal axis. To minimize wear and tear on the fabric covering the cabinet top 22, the upper corners at each end of the elongated massaging members 32 are rounded or moderately champhered such as shown generally at 34 in FIG. 4. The intermediate portions of the massaging members 32 are respectively arranged to define flat, upwardly-facing body-contacting surfaces as at 35.

The new and improved massaging means 23 of the present invention further include another group of transversely-oriented massaging members, as at 36, which are somewhat shorter than the other massaging members 32 but are otherwise generally identical to the longer members. The shorter members 36 are also arranged to respectively provide a flat, upwardly-facing body-contacting surface, as at 37, that extends the full length of the shorter member. As will be subsequently explained in more detail by way of reference to FIGS. 3 and 4, in the preferred embodiment of the new and improved apparatus 20, the massaging members 32 and 36 are cooperatively arranged to be loosely interfitted together so that they may be independently moved upwardly and downwardly in relation to one another as well as to the plate 25. Although the members 32 and 36 could alternatively be positioned in an alternate or a side-by-side relationship without departing from the scope of the invention, it is instead preferred to have an elongated slot, as at 38, in the upper body-contacting surface 35 of each longer member arranged for complementally receiving a depending skirt portion 39 on the shorter massaging members. End projections, as at 40, are arranged on the opposite ends of each of the shorter massaging members 36 to support them within their respectively-associated longer members 32. To allow the shorter members 36 to be independently moved upwardly and downwardly within the longer members 32, an elongated vertical slot, as at 41, is respectively formed in the mid-portion of each skirt portion 39 for loosely receiving the support rod 33. In this manner, as each of the associated members 32 and 36 in a given set of the massaging members is respectively moved in a common vertical plane perpendicular to the top plate 25, the members will each impart independent but coordinated massaging actions to closely-spaced portions on the upper and intermediate back areas of a person lying face-up on the cabinet top 22. It will, of course, be recognized that this unique interfitting relationship for each associated set of the several massaging members 32 and 36 enables a greater number of these members to be utilized in a given arrangement of the powered massaging means 23 than would otherwise be possible if these massaging members were instead installed in a side-by-relationship. Thus, it is preferred that this interfitting relationship be employed for the massaging means 23 of the invention to assure that the maximum number of individual massaging actions can be imparted to the back of a person being treated by the new and improved apparatus 20.

As depicted in FIGS. 1 and 3, the massaging means 23 of the present invention also include still another group of transversely-oriented massaging members, as at 42, which are similar, if not identical, to the shorter massaging members 36 and also have flat, body-contacting upper surfaces as at 43. The massaging members 42 are each appropriately sized and arranged to span the smaller rectangular opening 30 in the plate 25 so that the end projections of these massaging members will normally rest on the plate on opposite sides of the smaller opening. It will, of course, be recognized that this mounting arrangement enables this third set of massaging members 42 to be respectively capable of moving upwardly and downwardly independently of one another as well as in relation to the plate 25 so as to impart independent but coordinated massaging actions to the lower back areas of a person lying face-up on the cabinet top 22.

Those skilled in the art will, of course, understand that there are many types of electro-mechanical actuators which could be utilized with equal success with the massaging means 23 without departing from the scope of the invention. Nevertheless, it is considered important that the driving mechanism 28 is not unduly complicated and that this mechanism can be easily serviced and repaired by persons having little or no mechanical ability. It is also considered important that the driving mechanism 28 is capable of independently moving the massaging members 32, 36 and 42 in various sequences and at various rates that may be deemed advisable to achieve the objects of the present invention.

Figure 2:
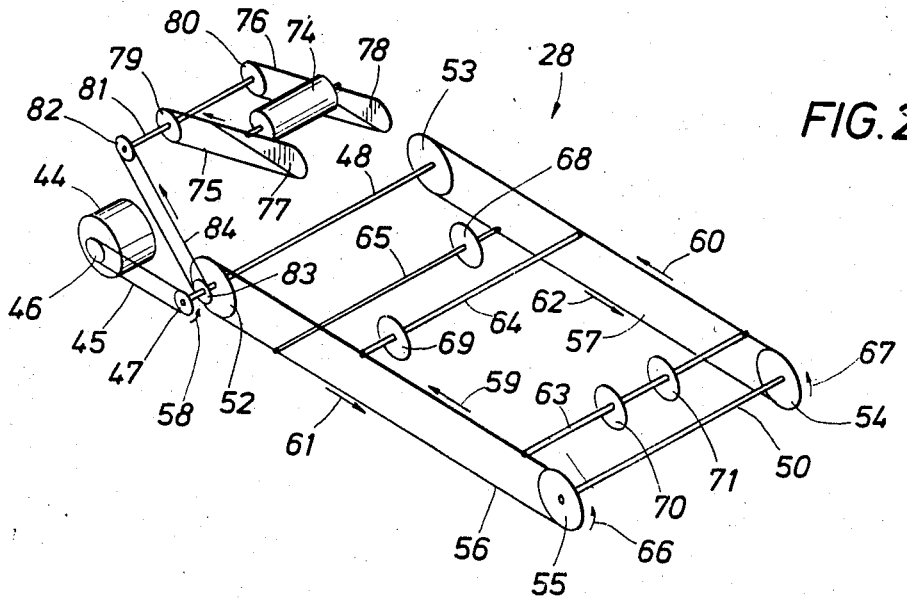
FIG. 2 is a somewhat-schematic isometric view of a preferred embodiment of the driving mechanism for the massaging apparatus shown in FIG. 1.

Accordingly, as illustrated schematically in FIG. 2, in its preferred form the driving mechanism 28 employs a high-torque, variable-speed motor 44 that is cooperatively coupled to the massaging means 23 by means such as a typical endless roller chain 45 carried on aligned chain-drive sprocket wheels 46 and 47 that are respectively mounted on the shaft of the motor and the outboard end of a horizontal transverse axle 48 that is rotatably journalled on a pair of bearings (such as shown at 49 in FIG. 8) that are respectively arranged on the adjacent portions of the spaced side members 26 and 27 for supporting the axle below the head-end of the plate 25 adjacent to and parallel to the motor shaft. The driving mechanism 28 also includes another horizontal transverse axle 50 which is similarly journalled on another pair of bearings (as the one shown at 51 in FIG. 8) arranged on the side members 26 and 27 for supporting the axle below the other end of the plate 25 parallel to and at the same elevation as the other axle 48. The driving mechanism 28 further includes matched sprockets 52–55 respectively mounted near the outboard ends of the axles 48 and 50 and cooperatively arranged for carrying a pair of longitudinally-disposed roller chains 56 and 57 which are respectively located just inside of the vertical side members 26 and 27 and below the longitudinal edges of the plate 25.

From FIG. 2 it will, of course, be recognized that when the driving motor 44 is operated for rotating the sprocket 47 in the direction indicated by the arrow 58, the paralleled chains 56 and 57 will be respectively rotating in unison with the upper portions of the chains advancing as shown by the arrows 59 and 60 just below the side edges of the plate 25 toward the head-end of the plate and the lower portions of the chains returning in the opposite direction as indicated by the arrows 61 and 62. The driving mechanism 28 further employs three axles or elongated shafts 63–65 which, as best seen in FIG. 5, have their outboard ends respectively pivotally coupled to longitudinally-spaced, transversely-aligned links in the paralleled chains 56 and 57 so as to support these shafts in a generally-horizontal position between the chains as the chains 56 and 57 are rotated as shown by the rotational arrows 66 and 67. In this manner, whenever the driving mechanism 28 is operated, the three shafts 63–65 will be successively advanced (as shown by the arrows 59 and 60) along a horizontal plane that lies just below the plate 25 toward the head-end of the massaging means 23 and (as shown by the arrows 61 and 62) successively returned in the opposite direction in a lower horizontal plane.

It will also be seen in FIG. 2 that a single roller 68 is mounted on the end portion of the transverse axle 65 that is adjacent to the side member 27 and that another single roller 69 is similarly mounted on the end portion of the shaft 64 that is adjacent to the opposite side member 26 of the frame 24. A closely-spaced pair of rollers 70 and 71 are also mounted on the transverse shaft 63 approximately midway between the side plates 26 and 27. Thus, as the paralleled chains 56 and 57 are being driven in the direction indicated by the arrows 66 and 67, the two single rollers 68 and 69 will be transported in separate continuous or looped paths respectively lying in vertical planes that are adjacent to the side members 26 and 27 of the frame 24, with the first of these single rollers being substantially in advance of the second roller. In a similar fashion, the two closely-spaced rollers 70 and 71 on the mid-portion of the third shaft 63 will move together in continuous looped paths lying in vertical planes midway between the two side plates 26 and 27 and these rollers will always be trailing the single roller 69 by a substantial distance. The respective functions of the several rollers 68–71 as well as the significance of the longitudinal spacings between these rollers will be subsequently discussed.

From FIGS. 3, 7 and 9, it will be recognized that the roller 68 is appropriately sized and situated on the shaft 65 so that as the chains 56 and 57 transport the roller along the upper horizontal plane lying just below the plate 25, this roller will successively engage depending portions, as at 72, respectively arranged near one end of each of the massaging members 32 thereby elevating those ends of the longer members above the upper plate as the roller passes below each of the longer members. The other roller 69 is similarly arranged on the opposite end of the shaft 64 for successively contacting depending portions, as at 73, that are respectively arranged near the opposite ends of the massaging members 32 and sequentially elevating those ends of the longer members above the plate 25. It will, of course, be realized that since the longer massaging members 32 are pivotally supported by the elongated support rod 33, elevation of one end of any given longer member will cause that particular member to tilt or tip around the rod in relation to the other longer massaging members. As previously described, since the end projections 40 support the shorter members 36 within the longer members 32, the shorter members will be carried along with the longer members as they are respectively tilted or rocked back and forth in relation to the support rod 33.

From FIGS. 4 and 5, it will be noted, however, that when the end projections 40 on the shorter members 36 are resting on the upper surfaces 35 of the longer members 32, the depending skirts 39 of the shorter massaging members will project below the lower longitudinal edges of the longer massaging members. Thus, as illustrated in FIG. 5, as the central rollers 70 and 71 are being transported in a horizontal plane immediately below the top plate 25, they will successively engage the lower longitudinal edges of the depending skirt portions 39 of the shorter members 36 so as to independently elevate the shorter massaging members with respect to their respectively-associated longer members 32. Since the central rollers 70 and 71 are laterally separated from one another, it will be appreciated that they will simultaneously elevate both ends of a given member 36 so that these shorter members will remain in a generally-horizontal position as they are elevated above the longer massaging members 32. It should be also noted from FIG. 3 that as the central rollers 70 and 71 are transported below the upper plate 25, the massaging members 42 will be successively elevated above the plate. It will be recalled that since the support rod 33 is loosely fitted within the elongated openings 41, the shorter massaging members 36 and 42 will not be tilted in relation to the upper plate 25.

Accordingly, as shown in FIGS. 1 and 3, it will be seen that as the roller 68 is progressively moved just below the upper plate 25, the adjacent ends of the longer members 32 will be successively elevated in relation to the plate; and that as the other roller 69 is progressively moved just below the upper plate, the opposite ends of the massaging members will similarly be successively elevated thereby imparting upward and downward undulating or rocking movements to their end portions which will appear to be successive waves that run first along one side of the upper plate and then run along the other side of the upper plate. It will be appreciated that the longitudinal spacing between the shafts 64 and 65 determines whether or not a given one of these successive waves is to begin before the preceding wave is completed. The longitudinal spacing between the shafts 63 and 64 will similarly determine the relationship between the upward and downward movements of the shorter massaging members 36 and 42. Inasmuch as the adjustment of these two longitudinal spacings can be done only by repositioning the shafts 63–65 on the roller chains 56 and 57, it is impractical to change these spacings during the course of a treatment. Nevertheless, it has been found that since the rotational speed of the driving motor 44 determines the rate at which the several massaging members 32, 36 and 42 will be respectively elevated above the plate 25, the speed of the motor can be varied as needed for performing any anticipated massaging treatment.

Of particular significance to the present invention, it will be appreciated that the successive undulating movements of the massaging members 32 will be effective for cooperatively imparting a moderate rocking action to successively-higher parts of the lower and intermediate back portions of a person lying on the top plate 25 which gently twists these back portions back and forth in relation to one another about the spinal column of the person. With the new and improved massaging apparatus 20 of the present invention arranged as illustrated in the drawings, the depicted longitudinal spacing between the shafts 64 and 65 will produce a sequential twisting action that passes upwardly along the left-hand side of the back of a person being treated (as the roller 68 advances toward the head-end of the plate 25) and then upwardly along the right-hand side of the person (as the other roller 69 advances toward the head-end of the plate). This action will, for example, cause the right hip of a person to be lifted immediately after his left shoulder has been lowered onto the top plate 25. On the other hand, since the shafts 64 and 65 can be selectively positioned on different links of the roller chains 56 and 57, it is considered to be within the scope of the invention to alternatively position these two shafts so as to be somewhat closer to one another should it be desired to produce a modified twisting action that would, for example, progress up the left-hand side of the person and be terminated by lifting the left hip of a person at about the same time that his right shoulder is being raised to start another massaging action that would then progress up the right-hand side of the back of that person.

Accordingly, as a significant aspect of the invention, it will be recognized that as the several massaging members are being successively raised and lowered, the longer members 32 will impart a rocking movement to a progressively-higher lateral back portions on the opposite sides of a person lying on the cabinet top 22 and the shorter members 36 and 42 will simultaneously impart upward and downward movements to progressively-higher portions of the spinal column of that person. It will be seen, therefore, that the back of a person lying in a supine position on the cabinet top 22 will be successively subjected to four independent but coordinated massaging actions: (1) an upward and downward twisting movement that is imparted to the lefthand end portions of successively-higher lumbar and dorsal vertebrae of the person as the roller 68 passes below the lefthand ends of the longer massaging members 32, (2) a corresponding upward and downward twisting movement that is imparted to the righthand end portions of sucessively-higher lumbar and dorsal vertebrae as the roller 69 passes below the righthand ends of the longer members, (3) an upward and downward vertical movement imparted to successively-higher caudal and sacral vertebrae of the person as the central rollers 70 and 71 pass below the lower massaging members 42, and (4) an upward and downward vertical movement of successively-higher lumbar and dorsal vertebrae of the person as the central rollers pass below the shorter massaging members 36.

Referring again to FIGS. 1, 2 and 3, it will be noted that the new and improved massaging means 23 further include a fourth massaging member such as a single transverse roller 74 cooperatively journalled between a pair of roller chains 75 and 76. Although each of the roller chains 75 and 76 could just as well be supported on a pair of sprocket wheels, it is preferred to instead arrange a pair of upwardly-inclined, laterally-spaced elongated plates 77 and 78 on the head-end of the frame 24 which respectively define a tract or peripheral guide around which the upper looped portions of the chains can move smoothly. The lower looped portions of the driving chains 75 and 76 are respectively supported on sprocket wheels 79 and 80 mounted on the opposite ends of a horizontal axle 81 that is rotatably journalled as by bearings (not seen in the drawings) on opposite sides of the frame 24. In this manner, the single roller 74 will be carried along an upwardly-inclined path that is centered in the smaller central opening 31 in the head-end of the top plate 25. To drive the roller 74 in cooperation with the massaging members 32, 36 and 42, sprockets 82 and 83 are mounted on the shafts 81 and 48 and cooperatively arranged for carrying a driving chain 84. Since it is preferred that the single roller 74 is also covered by the naugahyde fabric (not illustrated) covering the cabinet top 22, a pair of curved guards 85 and 86 are mounted along opposite sides of the smaller central opening 31 so as to cover the otherwise-exposed portions of the chains 75 and 76 as they slide along the upper edges of the inclined plates 77 and 78. It will, of course, be recognized that since the driving motor 44 will simultaneously rotate the shafts 48 and 81, the roller 74 will be continuously transported along a path that has its upper portion extending upwardly along the cervical or neck portion of a person lying in a supine position on the cabinet top 22 as the several massaging members 32, 36 and 42 respectively impart the aforementioned massaging actions on the back portions of that person.

It will, of course, be recognized that as the several members 32, 36 and 42 are successively elevated above the upper plate 25, each of the massaging members will respectively lift a significant portion of the total weight of the torso of a person that is lying on the cabinet 21. Accordingly, in the preferred manner of accommodating these substantial loads, the driving mechanism 28 is cooperatively arranged to support the outboard ends of the shafts 63–65 as they are moved along their respective paths. Accordingly, as shown in FIGS. 5, 7 and 9, a pair of laterally-spaced horizontal guides 85 and 86 are cooperatively arranged on opposite sides of the frame 24 just below the upper plate 25 for slidably supporting the upper portions of the chains 56 and 57 as they are moving toward the head-end of the frame. In this manner, the downwardly-acting weight of a person lying on the cabinet top 22 will not impose any significant load on the shafts 63–65 that might otherwise damage or break their pivotal connections with the chains 56 and 57. It is also preferred to arrange a similar pair of paralleled horizontal guides 87 and 88 along the lower portion of the frame 24 for supporting the lower portions of the roller chains 56 and 57 as they are moving toward the foot-end of the frame to eliminate sagging of the lower run of the chains.

Accordingly, it will be appreciated that the present invention has provided new and improved methods and apparatus for massaging selected neck and back portions of a person requiring treatment. By successively raising and lowering various spaced portions along first one and then the other side of the back of the person, those back portions will be successively twisted relative to the spinal column of the person to provide a gentle massaging action to the back of the person undergoing treatment. In a similar fashion, by successively raising and lowering spaced portions of the spinal column of the person, a gentle massaging action will also be imparted to the spinal column. By using the new and improved massaging apparatus of the present invention as described above, it has been described how the apparatus can be utilized to massage first the side back portions of the person and then the spinal column. Alternatively, by repositioning the actuating means for the spinal column body-contacting members, a massaging treatment may also be provided whereby the spinal areas are treated either before the sides of a person's back or after a massaging action is imparted to one side of the back and before a massaging action is imparted to the other side of the person's back.

While only a particular embodiment of the apparatus of the present invention has been shown and described herein, it is apparent that various changes and modifications may be made without departing from the principles of the present invention in its broader aspects; and, therefore, the aim in the appended claims is to cover all such changes and modifications as fall within the true spirit and scope of this invention.

What is claimed is:

1. A method for massaging the back of a person lying face-up in a supine position comprising the steps of:

successively raising and lowering progressively-higher portions along the entire righthand rear side of the rib cage of a person for sequentially twisting the ribs in the righthand back portions of the person back and forth about the associated dorsal and lumbar vertebrae in the spinal column of the person without simultaneously raising or lowering the lefthand back portions of the person;

successively raising and lowering progressively-higher portions along the entire lefthand rear side of the rib cage of a person for sequentially twisting the ribs in the lefthand back portions of the person back and forth about the associated dorsal and lumbar vertebrae in the spinal column of the person without simultaneously raising or lowering the righthand back portions of the person; and only after the righthand and lefthand back portions of the person have been twisted, beginning with a lower portion of the spinal column that is below the rib cage of the person, successively raising and lowering progressively-higher portions along the entire spinal column between said lower spinal column portion and the neck of the person for sequentially flexing the dorsal and lumbar vertebrae along the spinal column upwardly and downwardly.

2. The method of claim 1 wherein only after said progressively-higher portions along the spinal column between said lower spinal column portion and the neck of the person have been sequentially flexed, successively raising and lowering progressively-higher portions along the neck of the person for sequentially flexing the cervical vertebrae of the person.

3. Apparatus for massaging the back of a person lying face-up in a supine position and comprising:

a support having an upwardly-facing surface adapted to support at least the upper and intermediate back portions of a person lying thereon in a supine position and defining a central opening extending along the central longitudinal axis of said surface and having righthand and lefthand longitudinal sides respectively disposed on opposite sides of said central axis for providing access to selected back portions respectively disposed along and on opposite sides of the spinal column of a person lying thereon;

a first set of elongated, body-contacting members respectively having an elongated, upwardly-facing opening extending along its mid-portion and cooperatively disposed transversely across said central opening at spaced intervals along said central axis with their respective righthand and lefthand ends respectively positioned adjacent to said righthand and lefthand longitudinal sides of said central opening;

means cooperatively supporting said first body-contacting members for independent pivotal movement about said longitudinal axis for moving their respective righthand and lefthand ends into and out of contact with the righthand and lefthand sides of at least the upper back portions of a person lying on said surface;

a second set of elongated, body-contacting members respectively disposed in said upwardly-facing openings in said first body-contacting members and cooperatively arranged for moving upwardly and downwardly independently thereof into and out of contact with only the adjacent back portions spaced along the spinal column of a person lying on said surface; and selectively-operable actuating means cooperatively arranged for sequentially raising and lowering in succession in a first cycle of operation all of the ends of said first body-contacting members that are adjacent to one longitudinal side of said opening, sequentially raising and lowering in succession in a second cycle of operation all of the ends of said first body-contacting members that are adjacent to the other longitudinal side of said opening, and sequentially raising and lowering in succession in a third cycle of operation all of said second body-contacting members independently of the sequential movements of said first body-contacting members.

4. The massaging apparatus of claim 3 wherein said actuating means include means for varying the speed at which said first and second body-contacting members are successively raised and lowered.

5. The massaging apparatus of claim 3 further including a third set of elongated, body-contacting members cooperatively disposed transversely across said central opening at spaced intervals along said central axis for being moved by said actuating means upwardly and downwardly independently of one another into and out of contact with the adjacent lower back portions of a person lying on said surface.

6. The massaging apparatus of claim 5 further including a transversely-oriented body-contacting roller disposed adjacent to and outside of one end of said central opening, means on said support and cooperatively arranged to support said body-contacting roller in an operating position parallel to said first and second body-contacting members for being carried by said actuating means along the adjacent neck portions of a person lying on said surface, and means on said actuating means arranged for moving said body-contacting roller independently of said first and second body-contacting members.

* * * * *